US006692143B2

(12) United States Patent
Keller

(10) Patent No.: US 6,692,143 B2
(45) Date of Patent: Feb. 17, 2004

(54) METHOD AND APPARATUS FOR MIXING CORROSIVE MATERIAL

(76) Inventor: Robert B. Keller, 903 Jolen Ct., Bellaire, TX (US) 77401

( * ) Notice: Subject to any disclaimer, the term of this patent is extended or adjusted under 35 U.S.C. 154(b) by 145 days.

(21) Appl. No.: 10/087,392

(22) Filed: Mar. 1, 2002

(65) Prior Publication Data

US 2002/0124473 A1 Sep. 12, 2002

Related U.S. Application Data

(60) Provisional application No. 60/272,499, filed on Mar. 1, 2001.

(51) Int. Cl.[7] ..... B01F 13/02; B01F 15/00; E06B 3/00

(52) U.S. Cl. ..... 366/348; 366/347; 366/101; 366/349; 49/507

(58) Field of Search ..... 366/101, 106, 366/107, 182.4, 347, 349, 348; 49/507

(56) References Cited

U.S. PATENT DOCUMENTS

| | | | | | |
|---|---|---|---|---|---|
| 1,911,575 | A | * | 5/1933 | Lee | 366/348 |
| 2,915,023 | A | * | 12/1959 | Rapaport | 366/107 |
| 3,209,663 | A | | 10/1965 | Baier | |
| 3,613,723 | A | * | 10/1971 | Witt | 366/182.4 |
| 3,810,604 | A | * | 5/1974 | Reiter | 366/101 |
| 4,571,092 | A | * | 2/1986 | Switall | 366/348 |
| 4,878,758 | A | * | 11/1989 | Schafer et al. | 366/101 |
| 5,303,998 | A | * | 4/1994 | Whitlatch et al. | 366/101 |
| 5,346,302 | A | * | 9/1994 | Ryu | 366/101 |

* cited by examiner

*Primary Examiner*—Tony G. Soohoo

(57) ABSTRACT

A method and apparatus for mixing a corrosive mixture is provided. The apparatus having a lid for sealing an opening to the mixing vessel. The lid easily and quickly operated in addition to providing a secure pressure tight seal. It is necessary for the lid to be easily and conveniently operated to assure use of the lid.

2 Claims, 2 Drawing Sheets

METHOD AND APPARATUS FOR MIXING CORROSIVE MATERIAL

RELATED APPLICATIONS

This application claims benefit of priority from U.S. Provisional Application No. 60/272,499, filed Mar. 1, 2001 and entitled METHOD AND APPARATUS FOR SEALING A VESSEL FOR MIXING CORROSIVE MATERIAL, which is incorporated by reference herein.

TECHNICAL FIELD

The present invention relates to a method and apparatus for mixing corrosive material, and more specifically to a method and apparatus for mixing a corrosive material in a sealed vessel.

BACKGROUND

Everyday in various locations corrosive materials are mixed in vessels for use in commercial and industrial processes. In the oil industry, it is common for chemical solutions to be mixed and injected into wells for purposes ranging from inhibiting corrosion to cleaning portions of the adjacent formation. One very common practice is to inject acid solutions into a well to clean the formation to increase production. After the acid is injected, it is common to inject a alkaline solution, such as caustic soda or sodium hydroxide, into the well to neutralize the acid and prevent damage to the well and/or the formation surrounding the well.

The alkaline solution is very often mixed at the well site when needed. All too often workers are injured during this mixing process by the solution contacting the skin or from inhaling the fumes. Heretofore, it was common practice to dump bags of a chemical, such as caustic soda, into a mixing vessel or pot and mix with water. These vessels on occasions have a lid that is utilized to partially cover the top opening, which limits but does not prevent splashing of the solution or inhaling fumes as the solution is mixed.

It would be a benefit therefor to provide a method and apparatus for mixing corrosive material that facilitates an efficient and accurate method of mixing a desired solution while limiting workers to a hazardous exposure. It would be a further benefit therefore to provide a corrosive mixing vessel having a sealable cover. It would be a still further benefit to have a corrosive mixing vessel including a sealing cover, wherein the cover may be operated quickly, efficiently, and effectively promoting sealing of the vessel and increasing worker safety.

SUMMARY

A system and method of mixing a caustic solution is provided. The method of mixing a caustic solution, of the present invention, including the steps of providing a mixing vessel having a tub connected to a hopper via a valve, the hopper having a top opening; introducing a caustic chemical through the opening into the hopper; sealingly closing said opening with a lid; opening the valve depositing the caustic chemical on a screen disposed within said tub; closing the valve connecting the hopper and the tub; flowing a fluid into the tub to mix with the caustic chemical forming a caustic solution; introducing a gas into the tub to mix the caustic solution; and discharging the caustic solution for utilization.

The foregoing has outlined rather broadly the features and technical advantages of the present invention in order that the detailed description of a preferred embodiment of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
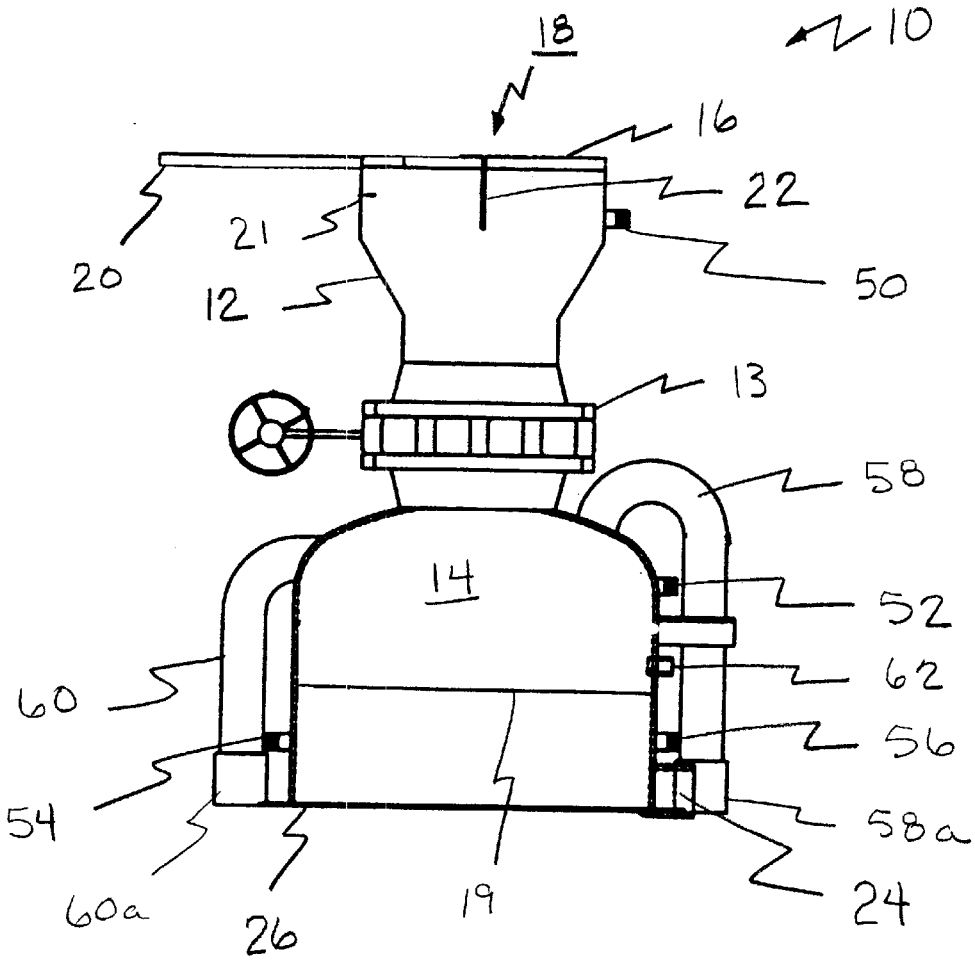
FIG. 1 is a side view of the corrosive material mixing apparatus having a sealing cover of the present invention.

Refer now to the drawings wherein depicted elements are not necessarily shown to scale and wherein like or similar elements are designated by similar reference numerals through the several figures.

FIG. 1 is a side view of the corrosive material mixing vessel having a sealing cover of the present invention, generally denoted by the numeral 10. Mixing vessel 10 includes a hopper 12, a tub 14, and a lid 16.

Mixing vessel 10 is constructed of material suitable for mixing corrosive material such as caustic soda. The method and apparatus will be described for use with caustic soda for brevity and clarity, although the mixer may be used for mixing many different solutions. Hopper 12 includes an opening 18 for loading hopper 12 with material. A loading tray 20 may extend from hopper 12 adjacent to opening 18 to aid in loading material into hopper 12. It is also desirable to have ears 22 attached to hopper 12 to facilitate lifting of vessel 10.

Hopper 12 has a fill mark line 21 indicating the level to which to fill hopper 12 with chemical. Tub 14 and hopper 12 are interconnected via a valve 13. Tub 14 further includes a bottom head or ring 26 adapted for connecting vessel 10 to a structure, such as a mud tank (not shown), by welding or bolting. A screen 19 is positioned within tub 14.

Mixing vessel 10 further includes ports for venting, dumping material, introducing liquids and/or gases, and for connecting instruments. All of the ports may be connected to the appropriate equipment in a manner well known in the art. Some of the connections include a water wash out line 50 at hopper 12. Tub 14 includes a water mixing line 52, a lower water washout line 54, a pressurized air connection 56, and upper vent line 58, a lower vent line 60, and at least one gauge connector 62 for a temperature and/or pressure gauge.

Figure 2:
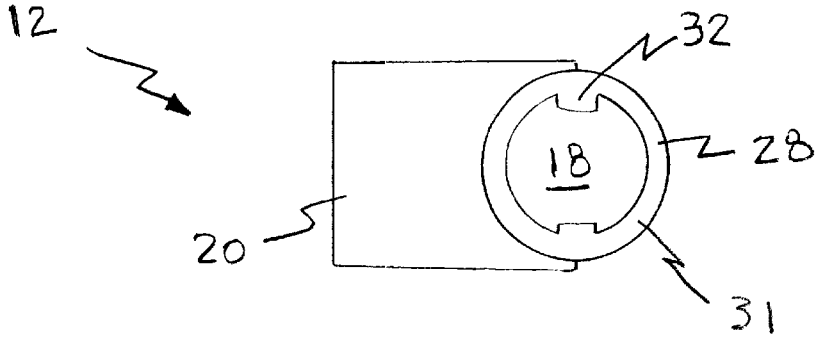
FIG. 2 is a top view of the hopper.

FIG. 2 is a top view of hopper 12. Hooper 12 includes an L-shaped deck ring 28 defining opening 18. Deck ring 28 includes a vertical wall 30 (FIG. 3) and a horizontal leg 31. Lips 32 extend inwardly from leg 31 to create a portion of deck ring 28 having a smaller inside diameter than the majority of deck ring 28.

Figure 3:
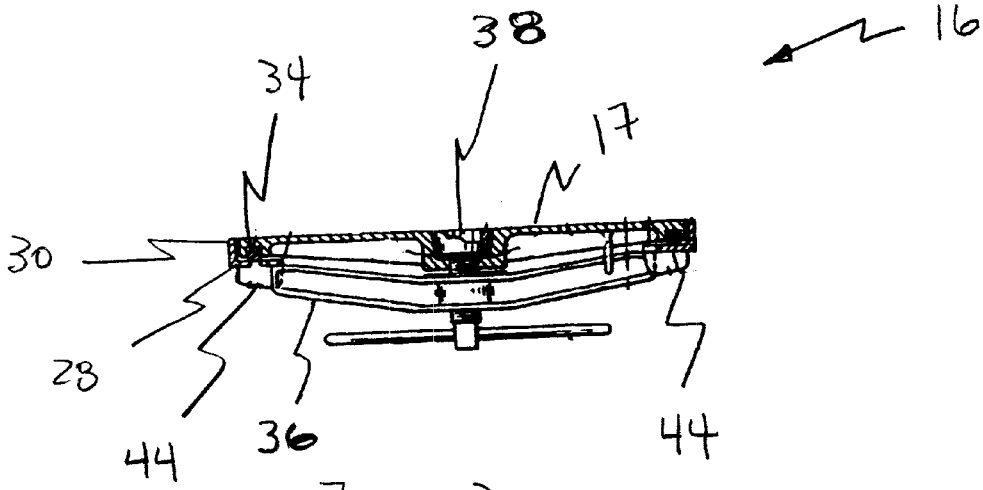
FIG. 3 is a partial cross-sectional view of deck ring and lid in the closed position.

FIG. 3 is a partial cross-sectional view the deck ring 28 and lid 16 in the closed position. Lid 16 includes a cover 17 and a locking bar 36 functionally connected to a lug 38. Locking bar 36 has a length less than the inside diameter of the majority portion of leg 31 and greater than the diameter between lips 32. Lid 16 is placed within deck ring 28 so that a portion of lid 16, including sealing elements 34, rest atop of leg 31 of deck ring 28. In the closed position, a locking bar 36 connected to lid 16 is located under lip 32 of deck ring 28. By tightening a lug 38, locking bar 36 is pulled toward lid 16 compressing sealing element 34 against leg 31, creating a sealed closure.

Figure 4:
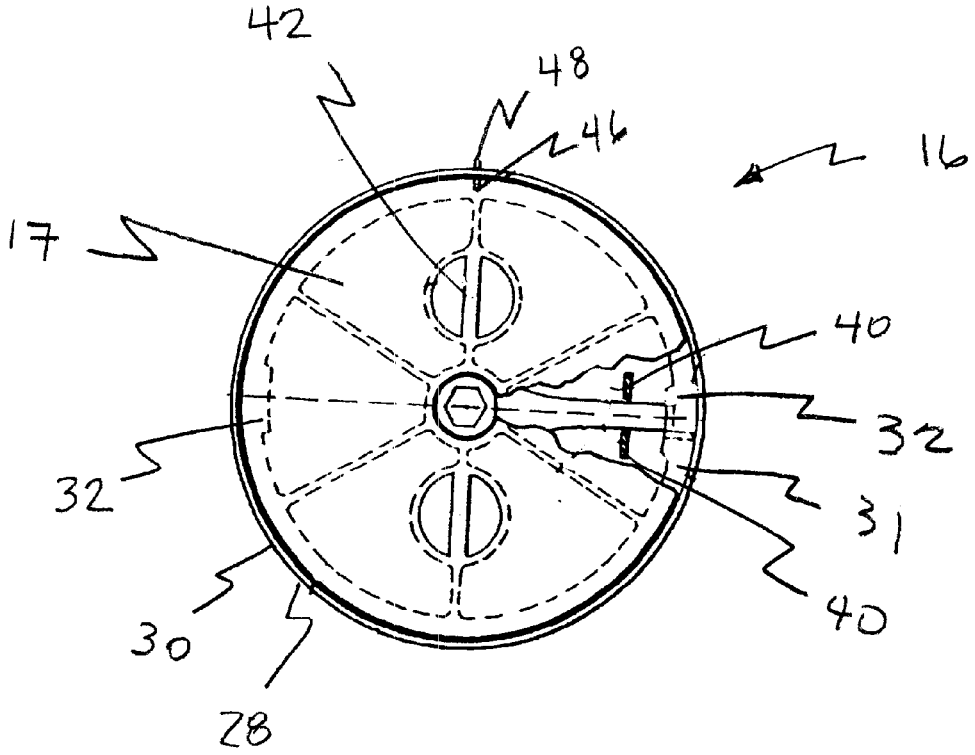
FIG. 4 is a partial cross-sectional view of the lid in the closed position within the deck ring.

FIG. 4 is a partial cross-sectional view of lid 16 in the closed position within deck ring 28. Lid 16 is placed within vertical wall 30 of ring 28, with locking bar 36 offset from lip 32. Stops 40 extend downwardly from an interior portion of lid 16 to maintain locking bar 36 in a set position. Lid 16 is then rotated utilizing handles 42 until locking bar 36 encounters stops 44 (FIG. 3). When stops 44 are encountered, locking arm 36 is positioned beneath lips 32, and is in the locked position. Additionally, marks 46 and 48 may be utilized to confirm that lid 16 is in the closed position. A tool, such as a wrench, is utilized to turn lug 38 to secure and seal lid 16.

A complete description of lid 16 is provided in U.S. Pat. No. 3,209,663 to Baier which is incorporated by reference herein. Although only a circular, unhinged lid 16 is shown in this embodiment it should be recognized that other configurations, either hinged or unhinged can be utilized.

A method of use of mixing vessel 10 and a sealing lid 16 is described with reference to FIGS. 1 through 5. Vessel 10 is lifted by ears 22 and placed over a tank (not shown) for installation. Bottom head 26 is secured to the tank, for example by bolting or welding. Various fluid lines, including gas and liquid lines, dump lines, and overflow lines are connected to vessel 10. A line is connected to a tank, such as a mud tank, to dump valve 24. A water line is connected to mixing line connection 52, preferably with both a valve and a check valve within the line. A pressurized air source is connected vial a line to tub 14 at connection 56. Do not use excessive air pressure in tub 14 Lower vent tube 60*a* should be connected to the tank above the standing fluid level, lower vent tube 60 is utilized to check fluid level in tub 14. Upper vent tube 58*a* should be directed into the mud tank above the fluid level or to a well ventilated area avoiding contact with humans or animals. Check air by filling tub 14 to lower vent 60*a* with water and using a regulator to control fluid roll in tub 14. Excessive air will force water out of lower vent tube 60*a*. A fluid source via a line is connected to lower wash out 54 to clean tub 14. Upper washout valve 50 in hopper 12 is for fume or vapor check and also for cleaning hopper 12 and valve 13 with fluid. Cover 16 should be closed during cleaning and fume check.

Once mixing vessel 10 is connected to a mud tank or other vessel established for transporting the caustic fluid for use, remove lid 16 on mixing unit 10. Check flapper valve 13 and screen 19 for debris and water in mixing unit. If debris or fluid is present, clean and drain. Close flapper valve 13 on mixing unit 10. Close valves 50, 52, 54, and 56. Pour caustic chemicals into hopper 12. A mark 21 may be provided to aid in identifying level of chemical to be used per mix. Check seal 34 on lid 15 for damage and replace if necessary. Install lid 16 in opening 18 of hopper 12, rotating lug 38 until lid 16 is sealingly secured to hopper 12. Open flapper valve 2 dumping the chemical on screen 19. Close valve 13. Open lid 16 to assure all the chemical is out of mixing hopper 12 and on screen 19. Reinstall lid 16 and seal opening 18 in hopper 12. Open water mixing valve 52 filling mixing tub 14 until fluid escapes lower vent tube 60*a*, then shut valve 52. Open air valve 56 introducing air to roll fluid and mix the solution in tub 14. Temperature gauge 62 is provided to monitor during the mixing process. With valves 50, 52, 54, 56 and valve 13 closed, open dump valve 24, dumping fluid mixture into the tank. From the tank the caustic mixture can be pumped where desired.

Although the present invention and its advantages have been described in relation to the illustrated embodiments if should be understood that various changes, substitutions and alterations can be made herein without departing from the spirit and scope of the invention as defined by the appended claims. For example, it should be realized that various elements as described in the various embodiments can be combined in varying combinations to satisfy the invention as claimed. As demonstrated above, elements of the invention that are the same or similar in various figures are numbered in a manner to reflect the similarity while numbering elements to correspond to the particular figure referenced.

What is claimed is:

1. A method of mixing a corrosive substance for utilization, the method comprising the steps of:

providing a mixing vessel having a tub connected to a hopper via a valve, said hopper having a top opening;

introducing a caustic chemical through said opening into said hopper;

sealingly closing said opening with a lid;

opening said valve disposing said caustic chemical on a screen disposed within said tub;

closing said valve connecting said hopper and said tub;

flowing a fluid into said tub to mix with said caustic chemical forming a caustic solution;

introducing a gas into said tub to mix said caustic solution; and discharging said caustic solution for utilization.

2. An apparatus for mixing corrosive material, said apparatus comprising:

a mixing vessel having a hopper including a deck ring defining an opening, said hopper connected to a tub via a valve, said tub having a bottom ring adapted for connecting to another tank; and a lid having a locking bar, said lid adapted for sealingly closing said opening by engaging a portion of said deck ring.

* * * * *